US006121729A

United States Patent [19]

Takao et al.

[11] Patent Number: 6,121,729

[45] Date of Patent: Sep. 19, 2000

[54] METAL HALIDE LAMP

[75] Inventors: Yoshifumi Takao; Toshiyuki Nagahara, both of Kanagawa, Japan

[73] Assignee: Stanley Electric Co., Ltd., Tokyo, Japan

[21] Appl. No.: 08/962,620

[22] Filed: Nov. 3, 1997

[30] Foreign Application Priority Data

Nov. 22, 1996 [JP] Japan ..... 8-312145

[51] Int. Cl.[7] ..... H01J 17/04; H01J 61/04; H01J 17/24; H01J 19/70

[52] U.S. Cl. ..... 313/631; 313/558; 313/559

[58] Field of Search ..... 313/631–32, 633, 313/558–59, 561–62, 491–93

[56] References Cited

U.S. PATENT DOCUMENTS

| | | | |
|---|---|---|---|
| 4,024,425 | 5/1977 | Higashi et al. | 313/562 |
| 4,415,833 | 11/1983 | Oetken et al. | 313/559 |
| 4,806,826 | 2/1989 | White et al. | 313/558 X |
| 4,806,828 | 2/1989 | Hurst | 313/558 |
| 4,851,735 | 7/1989 | Gosslar et al. | 313/631 |
| 4,859,905 | 8/1989 | White et al. | 313/558 |
| 4,968,916 | 11/1990 | Davenport et al. | 313/571 |
| 5,059,865 | 10/1991 | Bergman et al. | 315/82 |
| 5,108,333 | 4/1992 | Heider et al. | 445/26 |
| 5,256,935 | 10/1993 | Dobashi et al. | 313/558 X |
| 5,731,662 | 3/1998 | Parrott et al. | 313/559 X |
| 5,898,272 | 4/1999 | Mohacsi | 313/558 X |
| 5,936,350 | 8/1999 | Yoshida et al. | 313/631 |

*Primary Examiner*—Nimeshkumar D. Patel
*Assistant Examiner*—Mack Haynes
*Attorney, Agent, or Firm*—Morgan, Lewis & Bockius LLP

[57] ABSTRACT

A metal halide lamp and a method for making the same, in which one end of each electrode projects into a discharge chamber to form a light-emitting portion and the other end thereof is supported by a pinch-sealed portion. A coil is wound around at least the pinch-sealed portion of the electrode to absorb gaseous impurities caused by the heat generated during the operation of the metal halide lamp and to prevent cracking, at the pinch-sealed portion, of bulb. A coil, made of high melting point material and gaseous impurities absorption material, is wound around at least the pinch-sealed portion of the electrode and the combination is disposed into the bulb. The diameter of the coil, the internal diameter of a circle made by the coil, and the pitch of the coil are fixed within specific values in connection with the diameter of the electrode.

16 Claims, 2 Drawing Sheets

$D_0$ : DIAMETER OF THE ELECTRODE
$D_1$ : DIAMETER OF THE WIRE MATERIAL $D_1 = (10 \sim 50\ \%)\ D_0$
$D_2$ : INTERNAL DIAMETER OF THE COIL $D_2 = (104 \sim 140\ \%)\ D_0$

METAL HALIDE LAMP

This application claims the benefit of application No. HEI 08-312145 filed in Japan on Nov. 22, 1996, which is hereby incorporated by reference.

BACKGROUND OF THE INVENTION

1. Field of the Invention

This invention relates to metal halide lamps and the method for making the same, and more particularly to metal halide lamps used as light sources for liquid crystal projectors or head lamps for automobiles by taking advantage of its high color rendering properties.

2. Discussion of the Related Art

FIG. 2 of the accompanying drawings illustrates a conventional metal halide lamp 90 comprising bulb 91 formed of quartz glass enclosing discharge chamber 91*a* in which a pair of rod-shaped electrodes 92 is disposed such that one end of one electrode is opposite to an end of the other electrode.

One end of the electrode 92 projects a predetermined distance into the discharge chamber 91*a* to form light-emitting portion 92*a*. The other end of the electrode 92 is disposed within bulb 91 by pinch sealing to form a pinch-sealed portion 92*b*. The electrode is also connected to one of the metal foil elements 93 which is connected to an electrical conductive lead wire 94 that extends outside of the envelope of the lamp.

In the conventional metal halide lamp 90, several problems are encountered. Firstly, flaking of the electrode is promoted by the gaseous impurities, which are not consumed in the process, found in discharge chamber 91*a,* and the heating of the electrode. The flakes diffuse throughout the discharge chamber 91*a* and adhere to the internal surface of discharge chamber 91*a,* which can cause a decrease in the efficiency of transmission through the bulb 91, thereby decreasing its luminance. Secondly, the gaseous impurities in discharge chamber 91*a* may cause a decrease in the efficiency of metal halide lamp 90 by increasing the discharge starting voltage. Lastly, the heat generated by the operation of the lamp causes thermal expansion of pinch-sealed portion 92*b* of electrode 92, thereby requiring some means to prevent the sealed part of bulb 91 from cracking.

SUMMARY OF THE INVENTION

Accordingly, the present invention is directed to a metal halide lamp and the method to make the same, and the like, that substantially obviates one or more of the above problems due to the limitations and disadvantages of the related art.

An object of the present invention is the provision of a means to solve the flaking of the electrode promoted by the gaseous impurities present, which are not consumed in the process, and the heating effect on the electrode.

Another object of the invention is a reduction of the gaseous impurities in the discharge chamber to increase the efficiency of the metal halide lamp.

A further object of the invention is the prevention of the bulb from cracking by employing a coil with a getter material wound around the electrode.

A still further object of the invention is to provide a method of making a metal halide lamp to remove gaseous impurities from the discharge chamber and prevent cracking of the bulb.

The metal halide lamp of the present invention includes an electrode around which a coil is wound forming a helix with a pitch defined as the distance between the centers of adjacent windings of the coil divided by the diameter of the coil and multiplied by 100, wherein the pitch is from 100 to 500. The coil is formed of a high melting point material and a getter material, with a diameter from 10% to 50% of the electrode diameter, and is shaped in a helix having an internal diameter from 104% to 140% of the diameter of the electrode. The metal halide lamp further includes a discharge chamber into which one end of the electrode coil combination projects forming a light-emitting portion, while the other end of the electrode coil combination is disposed into a bulb body having a sealed portion.

In another aspect, the metal halide lamp, includes an electrode with a coil wound around the electrode, wherein the coil is formed of a high melting point material and a getter material. The lamp further includes a discharge chamber into which one end of the electrode projects forming a light-emitting portion and a bulb into which the other end of the electrode is disposed. It should be noted that in the electrode coil combination, described above, that the coil may be wound on only a portion of the electrode. Therefore, the coil may be wound over the entire length of the electrode or over any portion thereof, so long as the coil projects some distance into the discharge chamber.

It is to be understood that both the foregoing detailed description and the following general description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, an example of which is illustrated in the accompanying drawings.

Figure 1:
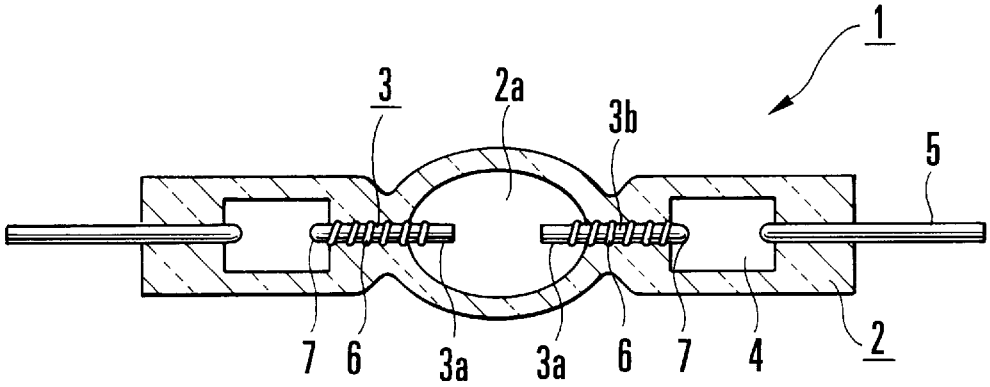
FIG. 1 is a cross-sectional view of a metal halide lamp in accordance with one embodiment of the present invention.
Figure 2:
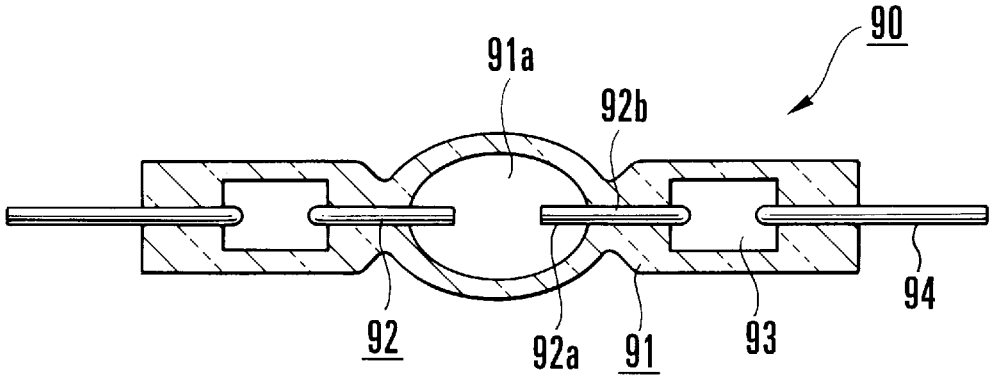
F I G. 2 PRIOR ART
FIG. 2 is a cross-sectional view of a conventional metal halide lamp.
Figure 3:
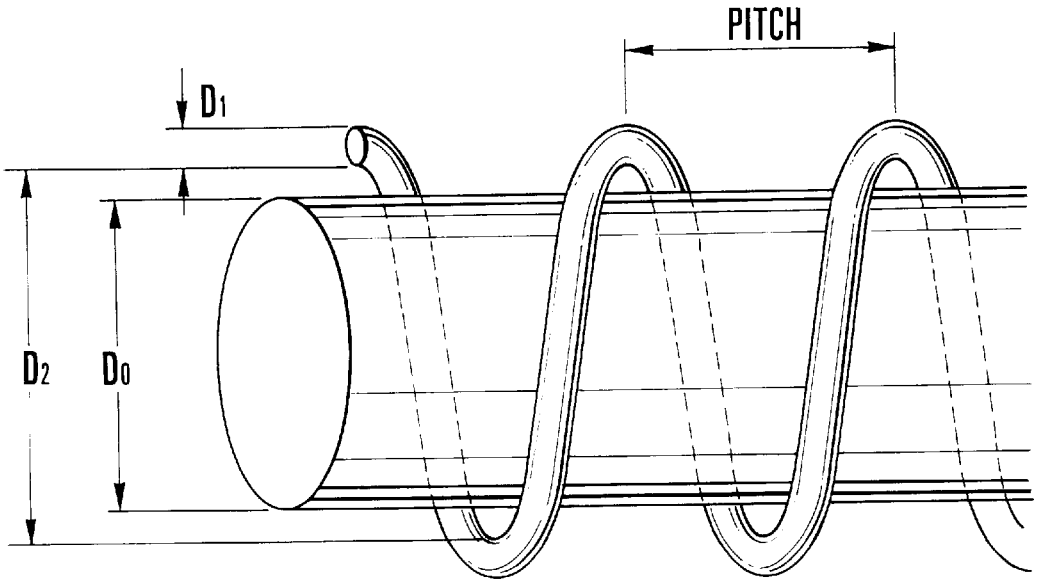
FIG. 3 is a side view of the electrode/coil combination.

In accordance with the invention, as depicted in FIG. 1, a metal halide lamp 1 including bulb 2, formed of quartz glass, encloses a discharge chamber 2*a* in which a pair of electrodes 7 are disposed by pinch-sealing to form pinch sealed portions 3 and 3*b*. The electrodes 7 project a predetermined distance into the discharge chamber 2*a* to form light-emitting portions 3*a*. The electrodes 7 are connected to a metal foil 4 which is connected to an electrical conductive lead wire 5 which extends outside of the envelope of the lamp. A coil 6 is wound around each of the pinch-sealed portions 3 and 3*b* of the electrodes 7. In a preferred embodiment, each electrode 7 is rod-shaped and each coil 6 is composed of a core material having a high melting point, such as Tungsten (W), Molybdenum (Mo) or the like, which has an exterior layer or cladding of a, or is doped with a, getter material such as Tantalum (Ta), Zirconium (Zr), Niobium (Nb) or the like.

Generally speaking, a wire material which forms each coil 6 has a diameter $D_1$ from 10% to 50% of the diameter $D_0$ of the electrode 7, and the internal diameter $D_2$ of a turn of the coil is from 104% to 140% of the diameter $D_0$ of the electrode 7.

Each coil 6 has a pitch and the formula of the pitch is based on the diameter $D_1$ of the wire material which forms the coil 6. The pitch of the coil 6 is one hundred times the distance between the center of one turn of coil and the center of the next turn of the coil at a corresponding location divided by the diameter $D_1$ of the wire material which forms the coil 6. Therefore, when the pitch is 100, a wire material is wound around an electrode such that adjacent turns of the coil contact each other. When the pitch is 500, the gap between the surfaces of two adjacent turns of the coil is four times the diameter $D_1$ of the wire material which forms the coil 6.

The placement of the coil 6 into the pinch-sealed portions 3, 3*b* is such that the coil 6 is wound around a suitable portion, generally at least the pinch-sealed portion, of the electrode 7. Alternatively, the coil 6 is formed in the shape of a helix and the electrode 7 is placed into the coil 6 a predetermined distance. The bulb 2 is then heated and melted and the coil 6 is disposed into the bulb 2 by the process of pressing or the like, allowing a portion of each coil 6 to project into the discharge chamber 2*a* to an extent that does not prevent the metal halide lamp 1 from discharging between the electrode ends 3*a*.

The internal diameter $D_2$ of the coil 6 is preferably no greater than 140% of the diameter $D_0$ of the electrode 7. If the internal diameter $D_2$ of the coil 6 is more than 140% of diameter $D_0$ of electrode 7, the coil 6 could be deformed such that during the pinch sealing process the pinch sealed portion 3, 3*b* could come into contact with electrode 7. Additionally, if the internal diameter $D_2$ of the coil 6 is not greater than 140% of the diameter $D_0$ of the electrode 7, it prevents the metal halide lamp 1 from experiencing a shift in its lumen output during lighting as time passes by.

The composition and configuration of the above-described coil 6 of the present invention results in the absorption of the gaseous impurities produced by the heat generated during the operation of the metal halide lamp. This absorption is performed by the getter material of the coils 6.

The present invention prevents the metal halide lamp 1 from experiencing a decrease in luminance caused by an increase in the transmission loss through the internal surface of discharge chamber 2*a,* and also prevents a decrease in efficiency caused by increasing the discharge starting voltage. According to experiments and testing of the inventors, 65% of the embodiments of the prior art not utilizing any means to prevent cracking, experience cracking after 1500 hours of illumination, whereas no sample of a metal halide lamp according to the disclosed embodiment of the present invention experienced such cracking.

It will be apparent to those skilled in the art that various modifications and variations can be made in the metal halide lamp of the present invention without departing from the spirit or scope of the invention. It is intended that the present invention cover the modifications and variations of this invention provided they come within the scope and spirit of the appended claims and their equivalents.

What is claimed is:

1. A metal halide lamp having a discharge chamber into which projects one end of an electrode to form a light-emitting portion and in which the other end of the electrode is supported in a sealed portion of the bulb comprising:

a coil wound around the electrode at the sealed portion thereof and extending into the discharge chamber, the coil being formed of a high melting point material and a getter material to absorb gaseous impurities in the chamber caused by operation of the lamp;

wherein the coil is formed of a wire material having a diameter from 10% to 50% of the diameter of the electrode, the coil forming a helix having an internal diameter from 104% to 140% of the diameter of the electrode and a pitch corresponding to the distance between the centers of corresponding points on adjacent turns of the coil divided by the diameter of the wire material which forms the coil and multiplied by 100, is in the range of 100 to 500.

2. The metal halide lamp of claim 1, wherein the electrode is rod-shaped.

3. The metal halide lamp of claim 1, wherein the coil is comprised of an inner and outer core, whereby the outer core is formed by doping or cladding.

4. The metal halide lamp of claim 3, wherein the inner core is formed of Tungsten or Molybdenum.

5. The metal halide lamp of claim 3, wherein the outer core is formed of Tantalum or Zirconium or Niobium.

6. A metal halide lamp, comprising:

an electrode;

a coil wound around the electrode, wherein the coil is formed of a high melting point material and a getter material;

a discharge chamber into which one end of the electrode projects forming a light-emitting portion; and a bulb body having a sealed portion into which the other end of the electrode and a portion of the coil are disposed.

7. The apparatus according to claim 6, wherein the coil is formed as a helix having a pitch defined as distance between the centers of adjacent windings of the coil divided by the diameter at corresponding locations of the wire material which forms the coil and multiplied by 100, wherein the pitch is from 100 to 500.

8. The apparatus according to claim 6, wherein the coil is wound around at least the pinch-sealed portion of the electrode.

9. The apparatus according to claim 6, wherein the electrode is rod-shaped.

10. The apparatus according to claim 6, wherein the coil is formed of a wire material having a diameter from 10% to 50% of the electrode diameter and is shaped in a helix having an internal diameter from 104% to 140% of the diameter of the electrode.

11. The apparatus according to claim 10, wherein the coil is formed as a helix having a pitch defined as distance between the centers of adjacent windings of the coil divided by the diameter at corresponding locations of the wire material which forms the coil and multiplied by 100, wherein the pitch is from 100 to 500.

12. The apparatus according to claim 11, wherein the coil is wound around at least the pinch-sealed portion of the electrode.

13. The apparatus according to claim 11, wherein the electrode is rod-shaped.

14. The apparatus of claim 6, wherein the coil is comprised of an inner and outer core, whereby the outer core is formed by doping or cladding.

15. The apparatus of claim 14, wherein the inner core is formed of a material such as Tungsten or Molybdenum.

16. The apparatus of claim 14, wherein the outer core is formed of a material such as Tantalum or Zirconium or Niobium.

* * * * *